United States Patent [19]

Muggli et al.

[11] 4,379,290

[45] Apr. 5, 1983

[54] ALARM DEVICE WITH A CONDITION SENSOR ELEMENT

[75] Inventors: Jürg Muggli, Männedorf; Gustav Pfister, Uerikon-Stäfa, both of Switzerland

[73] Assignee: Cerberus AG, Männedorf, Switzerland

[21] Appl. No.: 200,985

[22] Filed: Oct. 27, 1980

[30] Foreign Application Priority Data

Dec. 17, 1979 [CH] Switzerland ..... 11137/79

[51] Int. Cl.[3] ..... G08B 17/10

[52] U.S. Cl. ..... 340/629; 250/381; 340/636; 340/815.31

[58] Field of Search ..... 340/380, 629, 636; 455/609, 610, 613, 619; 250/212, 203, 381; 307/311

[56] References Cited

U.S. PATENT DOCUMENTS

| | | | |
|---|---|---|---|
| 3,619,612 | 11/1971 | Belke et al. | 250/212 X |
| 3,805,006 | 4/1974 | Chijuma et al. | 340/630 X |
| 4,071,753 | 1/1978 | Fulenwider et al. | 455/613 X |
| 4,075,512 | 2/1978 | Rast, Jr. et al. | 307/311 |
| 4,158,144 | 6/1979 | Krause | 307/311 X |
| 4,290,146 | 9/1981 | Adolfsson et al. | 455/613 |

OTHER PUBLICATIONS

The Bell System Technical Journal, vol. 58, No. 7, Sep. 1979, the Article of R. C. Miller et al., Entitled "Optically Powered Speech Communication Over a Fiber Lightguide", pp. 1735–1741.

*Primary Examiner*—John W. Caldwell, Sr.
*Assistant Examiner*—Daniel Myer
*Attorney, Agent, or Firm*—Werner W. Kleeman

[57] ABSTRACT

In an alarm installation containing a central evaluation unit and alarm devices arranged remotely therefrom, the transmission of energy from a radiation source and the reporting back of the signal occurs exclusively according to optical principles by means of radiation conducting elements, so-called light guides or conductors, by means of which the alarm devices are connected with the evaluation device. The alarm devices contain a preferably high-ohm sensor element, for instance a smoke-sensitive ionization chamber, whose operating voltage is infed by means of a solar cell which is irradiated by a light guide and whose output signal is fed back to the evaluation device by means of a high-ohm electrical transducer and a light guide. Such type alarm installation preferably is used for fire detection purposes, for gas, smoke temperature detection or intrusion protection, and is particularly suitable for use in an explosion-endangered environment or one subjected to electrical disturbances.

20 Claims, 8 Drawing Figures

ALARM DEVICE WITH A CONDITION SENSOR ELEMENT

BACKGROUND OF THE INVENTION

1. Technical Field

The invention relates to an alarm device containing a condition sensor element which, upon occurrence of a condition which is to be reported, alters its output potential or voltage, so that there is produced an alarm signal.

2. Field of Use of the Invention

Such alarm devices can be used for reporting undesired conditions or phenomena, for instance for detecting fires, the presence of dangerous gases or vapors, undesired temperature increases, or for intrusion protection purposes. The signal which is reported back can be employed as an alarm signal or for initiating protective or counter measures upon occurrence of the undesired condition or phenomena.

The sensor elements which are employed in the alarm device are tuned to the condition which is to be detected and, for instance, are structured as fire, smoke, gas, radiation, temperature or intrusion detectors. The invention can be particularly used to advantage in those applications where there are required sensor elements having high electrical resistance, for instance for ionization chambers used as fire detectors or alarms.

3. Prior Art

With heretofore known alarm installations the voltage supply is accomplished from an evaluation device to the individual alarm devices arranged remotely therefrom and reporting-back of the signal from such alarm devices to the central signal station, as a rule, is accomplished by means of electrical lines or conductors, if desired, also by wireless electrical transmission. However, such type transmission is extremely prone to disturbances and unreliable. When utilizing line transmission frequently electrical disturbances arise, for instance, network or mains pulses or electrical voltages are induced in the lines, which can lead to spurious response of the alarm devices and to faulty signal transmission. Due to the voltage drop in the lines the supply voltage fluctuates, so that complicated stabilization devices are needed. The components of the alarm devices are furthermore exposed to the effects of the environment, for instance are temperature-dependent, so that it is necessary to undertake complicated compensation measures. In special fields of application, especially in explosion-endangered environments, there are required further special protective measures when the infeed of the voltage occurs by means of the electrical lines. When using a wireless transmission technique and a special explosion-protected design of the alarm devices it is possible to overcome the last-mentioned drawback, yet as is well known wireless transmission is appreciably more prone to disturbances and less reliable because of the multiplicity of disturbances which can arise.

SUMMARY OF THE INVENTION

It is a primary object of the present invention to provide a new and improved construction of an alarm device having a condition sensor element which is not subject to the aforementioned drawbacks and limitations of the prior art constructions.

Another and more specific object of the invention aims at avoiding the described drawbacks of existing alarm devices and, in particular, providing an alarm device which does not require any electrical connections to an evaluation device, which operates free of disturbances, with great sensitivity and reliably over longer periods of time in a stable, accurate and voltage-independent manner, and having an expanded field of application, especially can be used in explosion-endangered environments and in the presence of electrical disturbances.

Now in order to implement these and still further objects of the invention, which will become more readily apparent as the description proceeds, the alarm device comprises an opto-electrical transducer which receives electromagnetic radiation by means of at least one radiation-conducting element, and thus, delivers an electrical potential for the voltage supply of the sensor element. Additionally, there is provided an electro-optical transducer which upon change of the output voltage of the sensor element produces an optical signal which can be removed by means of at least one further radiation conducting element and can be evaluated for generating an alarm or reporting-signal.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
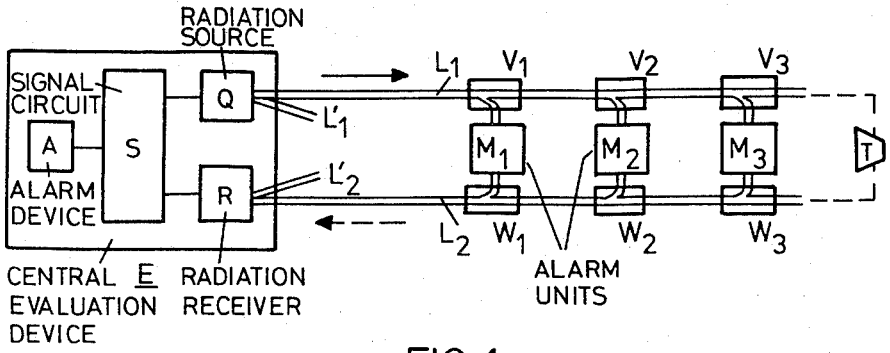
FIG. 1 illustrates an exemplary embodiment of an alarm installation containing parallel connected alarm devices.

Describing now the drawings, with the alarm installation illustrated by way of example in FIG. 1 there is provided a central evaluation device or unit E containing a radiation source Q and a radiation receiver R. The radiation source Q is powered by a conventional signal circuit S, and the output signal of the radiation receiver R is fed back to the signal circuit S. As soon as there has been detected a predetermined difference between the transmitted and received radiation, then the signal circuit S delivers an alarm signal to an alarm device A or causes, for instance, by means of an electronic data processor the initiation of protective or counter measures. Signal circuits suitable for the purposes of the invention are well known in many different constructional embodiments, for instance from the technology of optical condition detectors, for instance smoke detectors.

The radiation of the radiation source Q is distributed by a first radiation conducting element $L_1$, which also can be referred to as fiber optic element, hereinafter briefly termed a light guide or conductor, to a number of alarm devices or units $M_1$, $M_2$, $M_3$ and so forth arranged in spaced relationship or remotely from the evaluation device E, these alarm devices containing suitable sensors for sensing the condition which is to be detected. The coupling-out and coupling-in of the radiation for the individual alarm devices $M_1$, $M_2$, $M_3$ . . . is accomplished in a manner conventional in light guide technology with the aid of branch elements or branches $V_1$, $V_2$ . . . and $W_1$, $W_2$ . . . of suitable construction, as is also the connection to the individual alarm devices by means of standard and well known connections. The radiation is removed from the individual alarm devices $M_1$, $M_2$, $M_3$ . . . and is fed back by means of a second light guide or conductor $L_2$ to the receiver R located in the evaluation device E. The individual alarm devices $M_1$, $M_2$, $M_3$ . . . are connected together into a group parallel to the evaluation device E by means of the light guides or conductors $L_1$ and $L_2$. The entire group of alarm devices can be connected following the last alarm device by an end or terminal element T serving for monitoring the functioning of the light guides.

It is here remarked that it would be possible to connect with the radiation source Q and the radiation receiver R further such groups of parallely connected alarm devices by means of additional light guides, such as the light guides $L'_1$, $L'_2$ of FIG. 1 by way of example.

The light guides which are employed can either consist of a single fiber or of a number of fibers i.e. light guide bunches or bundles. Also it is possible to combine the infeed line or conductor $L_1$ and the return line or conductor $L_2$ into a single bunch. The nature of the light guides can be selected depending upon the requirements and while correlated to the different types of alarm devices.

As the radiation source Q there can be used in principle a random suitable lamp, a light or infrared emitting diode or a laser, wherein the spectral distribution can be wide-band, monochromatic, multi-monochromatic. However, it is advantageous to select the spectrum of such radiation source Q such that the same is accommodated to the transmission properties of the light guides when using monomode-light guides as well as to the properties of the radiation receiver R. It can be advantageous to operate the radiation source Q intermittently or in a pulse-like fashion, for instance at a frequency of 30 Hz or to construct the branch elements in known manner so as to be controllable in such a way that the individual alarm devices sequentially receive at different times radiation in the form of an optical multiplex.

The radiation receiver R is advantageously tuned to the radiation source Q and can, for instance, be constructed as a photoconductor (Si, GaAs, PbSe, InSb), as a pyroelectric element ($LiTaO_3$, TGS, $PVF_2$) or as a bolometer.

Figure 2:
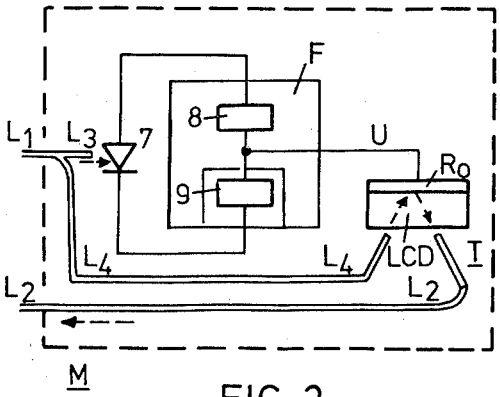
FIG. 2 illustrates the principle construction of a fire alarm.

FIG. 2 illustrates an alarm device M having a high-ohm sensor element F which for operation needs a voltage supply of several volts, however only has an extremely low current consumption. The sensor element F contains a sensor or feeler 8 whose electrical resistance alters in the presence of a condition magnitude which is to be detected, this sensor 8 being connected in series with a reference element 9. With such arrangement, as is well known, the voltage drop at the sensor or feeler 8 changes, and therefore, also the output potential U of the sensor element upon change of the condition parameter which is to be monitored. In order to supply the series connected elements 8 and 9 with voltage there can be used one or a number of solar cells, for instance silicon diodes which receive radiation from a branch or branch portion $L_3$ of the light guide or conductor $L_1$. If the resistance of the sensor element F is large enough and the current consumption correspondingly small, the voltage generated by such solar cells or the silicon diode 7 is completely sufficient for operating the sensor element F.

The output potential or voltage U of the sensor element F controls a likewise extremely high-ohm electro-optical transducer T. This transducer T can consist of an element LCD having electrically controllable radiation permeability or reflection, for instance a suitable liquid crystal which is mounted at a reflecting surface RO defining a control connection. There is infed to this transducer T radiation by means of a branch or branch portion $L_4$ of the light guide or conductor $L_1$ and the radiation is again removed by the light guide $L_2$. Normally, as long as the liquid crystal LCD is light pervious, no signal is conducted back by means of such light guide or conductor $L_2$. However, if at a certain condition change the output potential U of the sensor element F and thus the control voltage of the transducer T exceeds a certain threshold then the liquid crystal becomes transparent so that the radiation infed by means of the light guide or conductor $L_4$ is reflected by the reflector $R_0$ and the evaluation device E receives radiation by means of the light guide or conductor $L_2$. Such LCD-elements are known from the watch industry.

Figure 3:
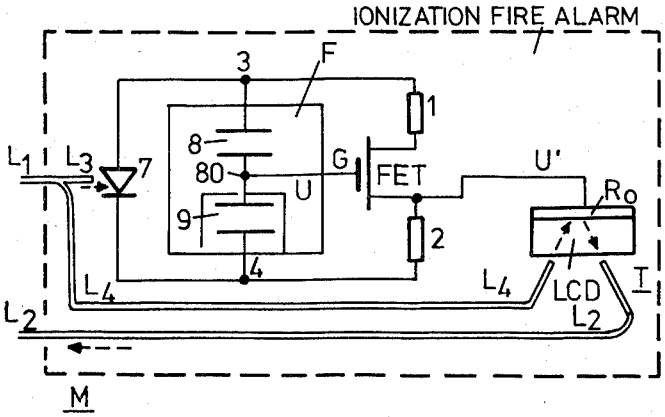
FIG. 3 illustrates the principle construction of an ionization fire alarm.

FIG. 3 illustrates an alarm device constructed as an ionization fire alarm. Here, the sensor 8 is constructed as an air accessible ionization chamber and the reference element 9 as a less air accessible or smoke-sensitive ionization chamber. Both ionization chambers. contain suitable radioactive sources for ionizing the air in the chambers, as is well known for such type fire alarms. With this arrangement the potential U at the connection point or terminal of both ionization chambers 8 and 9 changes in accordance with the smoke density appearing in the air accessible ionization chamber 8.

A particular advantage with the design of the sensor as an ionization chamber is the exceptionally great internal resistance, and thus, the particularly low current consumption, so that the radiation output delivered by the evaluation device is adequate for operating a large number of parallel connected alarm devices.

With this design it can be advantageous if the output potential U of the sensor element is not directly supplied to the electro-optical transducer T, rather by means of a field-effect transistor FET serving as an impedance converter and threshold value switch.

The gate G of such field-effect transistor FET is connected with the connection point or terminal 80 of both ionization chambers 8 and 9 and the source and drain of such transistor FET are connected, as shown, by the resistors 1 and 2 with the terminals 3 and 4 of the sensor element.

It is here indicated that instead of using the ionization chambers 8 and 9 it would be possible to also employ other high-ohm condition sensors or feelers, which respond to other condition parameters which are to be detected, for instance to certain gases or vapors, to moisture, temperature or pressure changes and so forth.

Figure 4:
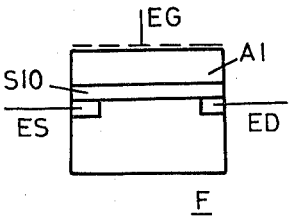
FIG. 4 illustrates a fire-sensor element.

FIG. 4 illustrates as a high-ohmic sensor or feeler F a semiconductor element, for instance a MOSFET, a MOS-capacitor or a Schottky diode containing a gas, temperature, moisture, smoke or pressure-sensitive active layer AI. There is known for instance as a MOSFET (e.g. from the publication "Science" 200 (1978), page 1371) a pressure and temperature sensitive MOSFET-structure, wherein the active layer AI consists of polarized polyvinylidene-fluoride. Another example is the so-called "charge flow" transistor (CFT, "IIEE of Solid-State Circuits", Volume SC-14 (1979), page 753) wherein the active layer consists of poly-(p-aminophenyl-acetylene) whose characteristic changes as a function of moisture and where can be applied to a silicon dioxide layer SIO. A further example is the hydrogen sensitive MOSFET-structure, wherein the active layer AI consists of paladium metal (cf. "Vacuum"27 (1976), page 245). Sensors of the described type thus constitute high-ohm controllable semiconductors, wherein the insulation layer corresponds to a gas, temperature, moisture, pressure or smoke-sensitive insulation layer AI, for instance formed of a $PVF_2$ (polyvinyldifluoride) layer. The bias at the gate electrode EG is set approximately to the threshold value for the conductivity between the source electrode ES and the drain electrode ED. Under the influence of the ambient conditions this conductivity changes.

Figure 5:
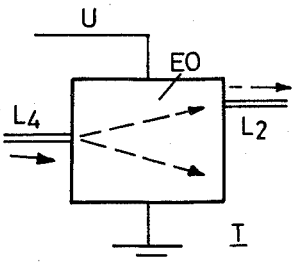
FIG. 5 illustrates a first embodiment of an electro-optical transducer.

Furthermore, the employed electro-optical transducers are not limited to the illustrated example using a liquid crystal, rather there also can be employed other such elements. For instance, FIG. 5 illustrates an electro-optical transducer containing electrically controllable radiation deflection, for instance of the $LiNbO_3$ type. Such type of transducer T contains a chip EO which has the property that when there is applied an electrical potential U the light which is radiated-in by means of the light guide or conductor $L_4$ is deflected in different directions as a function of the potential. The light guide or conductor $L_2$ which receives the radiation is arranged at a location corresponding to an output voltage of the sensor element F, and thus, corresponds to an input voltage U of the transducer at which there should be given an alarm.

Figure 6:
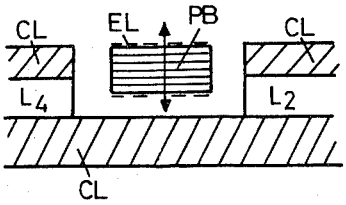
FIG. 6 illustrates a second embodiment of an electro-optical transducer.

FIG. 6 illustrates an electro-optical transducer in which the passage of the radiation beam or rays in the air space between both of the light guides or conductors $L_4$, $L_2$ is changed by a piezoelectric element PB, for instance, constituted by a multi-layer polyvinyldifluoride ($PVF_2$)-structure which has become known commercially as a "bimorphous structure", which is arranged in a gap or space between the light guides or conductors $L_4$, $L_2$. These light guides $L_4$, $L_2$ are covered with a jacket or covering CL and the piezoelectric element PB is provided at both external sides or faces with electrodes EL.

Figure 7:
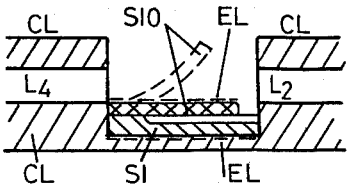
FIG. 7 illustrates a further embodiment of an electro-optical transducer.

FIG. 7 illustrates as a further embodiment an electro-optical transducer in which the passage of the radiation beam or rays in the air space or gap between both of the light guides or conductors $L_4$, $L_2$ is changed by an electrostatic semiconductor switch SI. In this case there is moved, for instance a silicon oxide layer SIO into the path of the radiation rays by applying a voltage $V_1$, $V_2$ between the electrodes EL. This element SIO-EL additionally works as a bimetallic element, so that a fire alarm equipped with such element is both smoke and temperature sensitive. The semiconductor switch also can be constructed like stepping motors used in the watch industry.

It is possible to obtain an alarm device in the described manner wherein there is accomplished purely optically both the transmission of the output needed for operating the sensor element and also the signal transmission back to the evaluation device. It is to be expressly understood that the selection of the sensor elements is not limited in any way to the mentioned components or devices rather there can be used random and to particular advantage high-ohmic feelers or sensors for random condition magnitudes or parameters, such as for instance thin layers, semiconductors, especially high-ohm transistors of the MOS-type or piezoelectric elements which alter their properties under the influence of the ambient conditions and, for instance, respond to a combustion phenomenon.

Figure 8:
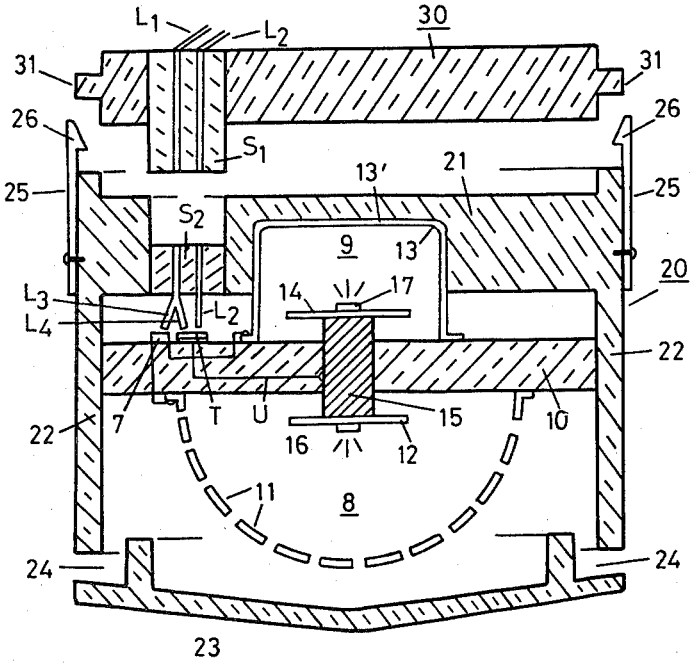
FIG. 8 illustrates details of the construction of an ionization fire alarm.

FIG. 8 illustrates the construction of an alarm device designed as an ionization fire alarm which functions according to the principles explained previously in conjunction with FIGS. 2 and 3. The construction of the ionization chambers can be accomplished for instance according to Swiss Pat. No. 551,057 or U.S. Pat. No. 3,908,957, to which reference may be readily had the disclosure of which is incorporated herein by reference.

The fire alarm contains an external ionization chamber 8 and an internal ionization chamber 9 which are arranged at both sides or faces of an electrically insulating support or carrier plate 10. The first ionization chamber 8, serving as the sensor element, possesses an external electrode 11 constructed as a metal grid, through which there can penetrate air into the interior of the ionization chamber 8. The outer or external electrode 13' of the other ionization chamber 9, serving as a reference chamber, is provided, on the other hand, with an extensively air impervious metal hood 13 serving as the outer electrode 13'. As the counter electrodes there are provided in each instance within the chambers 8 and 9 a metal disc 12 and 14, respectively, which are conductively connected with a metallic punch or plug 15 and which in each case can carry a suitable radioactive source 16 and 17 for ionizing the interior of the chambers 8 and 9. If an electrical potential is applied between the outer electrodes 11 and 13 then there thus flows a certain ionic current through the series connected ionization chambers 8 and 9, i.e. between the electrodes 11 and 12 as well as between the electrodes 13 and 14, and at the connection point i.e. at the punch-like element 15 there appears a predetermined potential or voltage U. As soon as smoke penetrates into the air accessible ionization chamber 8 then its electrical resistance changes, and thus, there likewise changes the ionic current and the potential U at the connection point 15.

The support plate 10 is mounted in a housing 20 which contains a base plate 21, a therewith connected cylinder portion 22 and a cover 23. Between the cylinder portion 22 and the cover or cover member 23 there is provided a ring-shaped or annular opening 24 for the entry of air into the smoke-sensitive ionization chamber 8.

Continuing, it will be seen that the housing 20 is connectable with a socket portion 30 which, for instance, is secured to the ceiling of the room or area to be monitored. This connection can be accomplished, for instance, by an appropriate bayonet or snap-type closure, wherein projections 26 of a number of snap springs 25 or equivalent structure provided at the housing 20 slide over a ring-shaped web or collar 31 at the socket portion 30 and lock at this location.

The socket portion 30 is connected by means of the light guides or conductors $L_1$ and $L_2$ with a central evaluation device, like the evaluation device E of FIG. 1. These light guides terminate at a plug or socket element $S_1$ located at the underside of the socket portion 30. As a counter element the base 21 is provided with a therewith fitting light guide bushing $S_2$. Light guide connections of this type are commercially available and well known in this technology. As to the many different constructions which have been disclosed there is mentioned, by way of example those appearing in European patent publication Nos. 6,662 and 8,709. For instance, there can be used for this purpose a "connector C-21" commercially available from Hughes Aircraft Company.

As already described previously in conjunction with FIG. 2, the radiation arriving by means of the light guide or conductor $L_1$ is infed by means of a branch line or branch $L_3$ to the opto-electrical transducer 7, for instance a solar cell battery, which is connected with both outer electrodes 11 and 13 of the ionization chambers 8 and 9 and infeeds a voltage or potential to the series circuit of both chambers. The punch-like element 15 interconnecting the counter electrodes 12 and 14 is connected with an electro-optical transducer T, for instance of a type as previously described, which receives the radiation by means of the other branch $L_4$ of the light guide $L_1$ and which removes the reflected radiation from the light guide $L_2$ and returns such back to the evaluation device E by means of the plug connection means $S_2$, $S_1$ and the socket portion 30.

An ionization fire alarm constructed in this manner possesses all of the advantages of conventional ionization fire alarms as concerns optimum smoke sensitivity and a particularly incipient response to the smallest traces of smoke, but on the other hand avoids the drawbacks which are associated with the requirement of the voltage supply and the signal reporting-back by means of electrical lines. Such ionization fire alarm can be particularly advantageously employed when there are to be expected electrical disturbances in the lines or when working in an explosion-endangered environment or atmosphere.

While there are shown and described present preferred embodiments of the invention, it is to be distinctly understood that the invention is not limited thereto, but may be otherwise variously embodied and practiced within the scope of the following claims.

What we claim is:

1. An alarm device comprising:

a condition sensor element for delivering an output voltage which upon occurrence of a condition which is to be reported alters said output voltage in order to initiate giving of an alarm signal;

an opto-electrical transducer operatively connected with said sensor element for applying an electrical potential thereto;

at least one radiation-conducting element for transmitting electromagnetic radiation to said opto-electrical transducer in order to thereby deliver said electrical potential for the voltage supply of the sensor element;

an electro-optical transducer operatively connected with said sensor element;

an input radiation-conducting element for infeeding electromagnetic radiation to said electro-optical transducer;

an output radiation-conducting element for outfeeding electromagnetic radiation from the electro-optical transducer; and said electro-optical transducer modulating, in response to said sensor element, the electromagnetic radiation passing from said input radiation-conducting element to said output radiation-conducting element.

2. The alarm device as defined in claim 1, wherein:

said sensor element contains an element which is sensitive to a combustion phenomenon.

3. The alarm device as defined in claim 2, wherein:

said sensor element which is sensitive to a combustion phenomenon comprises an air accessible ionization chamber.

4. The alarm device as defined in claim 3, wherein:

said sensor element further includes an additional ionization chamber with which the air accessible ionization chamber is connected in series; and said additional ionization chamber being connected in series with output means of the opto-electrical transducer.

5. The alarm device as defined in claim 4, wherein:

said additional ionization chamber is less accessible to air than said air accessible ionization chamber.

6. The alarm device as defined in claim 4, wherein:

said additional ionization chamber comprises a smoke-sensitive ionization chamber.

7. The alarm device as defined in claim 4, further including:

means defining a light guide connection portion;

a base plate;

a socket portion with which the base plate can be connected;

said opto-electrical transducer and the electro-optical transducer being arranged at a rear face of the light guide connection;

a counter element provided for the light guide connection portion; and said counter element being arranged within the socket portion and constituting an optical contact between components of individual light guides defined by said radiation-conducting elements.

8. The alarm device as defined in claim 7, further including:

a support plate having a lower face and an upper face;

said opto-electrical transducer and said electro-optical transducer being arranged upon said support plate;

said lower face of said support plate carrying the air accessible ionization chamber;

the upper face of said support plate carrying the additional ionization chamber;

said support plate being arranged below the base plate; and said base plate containing the light guide connection portion.

9. The alarm device as defined in claim 4, wherein:

both of said ionization chambers are inter-connected at a connection terminal;

a field-effect transistor having a gate, source electrode and drain electrode;

said electro-optical transducer having a control connection;

said connection terminal of both ionization chambers being connected with the gate of said field-effect transistor; and one of said electrodes of the field-effect transistor being connected with said control connection.

10. The alarm device as defined in claim 1, wherein:

said sensor element comprises a high-ohm semiconductor element having an active insulation layer.

11. The alarm device as defined in claim 1, wherein:

said opto-electrical transducer comprises at least one solar cell.

12. The alarm device as defined in claim 1, wherein:

said electro-optical transducer contains an element having electrically controllable optical permeability.

13. The alarm device as defined in claim 1, wherein:

said electro-optical transducer contains an element having electrically controllable optical reflection.

14. The alarm device as defined in claim 1, further including:

means defining a reflecting surface at which there is reflected the infed radiation, after passing the element of the electro-optical transducer, as a function of its degree of optical reflection and such reflected radiation is removed by said output radiation-conducting element.

15. The alarm device as defined in claim 1, further including:

means defining a reflecting surface at which there is reflected the infed radiation, after passing the element of the electro-optical transducer, as a function of its degree of transmission and such reflected radiation is removed by said output radiation-conducting element.

16. The alarm device as defined in claim 1, wherein:

said opto-electrical transducer comprises a solar cell;

means defining a common light source for powering said solar cell and for infeeding said electromagnetic radiation to said electro-optical transducer;

means cooperating with said common light source such that a portion of the light emitted by said common light source powers said solar cell; and said input radiation-conducting element feeding another portion of said light emitted by said common light source in the form of said electromagnetic radiation to said electro-optical transducer where such electromagnetic radiation is modulated by said electro-optical transducer.

17. The alarm device as defined in claim 16, wherein:

said electro-optical transducer comprises a low-current consuming electro-optical transducer; and said common light source comprises a low-light intensity source.

18. The alarm device as defined in claim 17, wherein:

said low-current consuming electro-optical transducer comprises a liquid crystal.

19. The alarm device as defined in claim 18, wherein:

said sensor element comprises a low-current consuming sensor element affording safety in an explosion-prone environment.

20. An ionization alarm device comprising:

an ionization fire alarm structured as a high-ohmic low-current consumption sensor for delivering an output voltage upon occurrence of a condition in the form of a combustion phenomenon which is to be reported;

an opto-electrical transducer operatively connected with said ionization fire alarm for applying an electrical potential thereto;

at least one radiation-conducting element for transmitting electromagnetic radiation to said opto-electrical transducer in order to thereby deliver said electrical potential for the voltage supply of the ionization fire alarm;

a low-power consuming electro-optical transducer constituted by a liquid crystal operatively connected with said ionization fire alarm;

an input radiation-conducting element for infeeding electromagnetic radiation to said liquid crystal;

an output radiation-conducting element for outfeeding electromagnetic radiation from the liquid crystal; and said liquid crystal modulating, in response to said ionization fire alarm, the electromagnetic radiation passing from said input radiation-conducting element to said output radiation-conducting element.

* * * * *